US007621297B2

(12) United States Patent
Debaes

(10) Patent No.: US 7,621,297 B2
(45) Date of Patent: Nov. 24, 2009

(54) METHOD FOR WEAVING A FABRIC AND FABRIC WOVEN ACCORDING TO SUCH A METHOD

(75) Inventor: Johny Debaes, Moorslede (BE)

(73) Assignee: N.V. Michel Van de Wiele, Kortrijk/Marke (BE)

( * ) Notice: Subject to any disclaimer, the term of this patent is extended or adjusted under 35 U.S.C. 154(b) by 106 days.

(21) Appl. No.: 11/899,280

(22) Filed: Sep. 5, 2007

(65) Prior Publication Data

US 2008/0053557 A1 Mar. 6, 2008

(30) Foreign Application Priority Data

Sep. 5, 2006 (BE) ..... 2006/0449
Dec. 12, 2006 (BE) ..... 2006/0610

(51) Int. Cl.
*D03D 39/16* (2006.01)
*D03D 39/00* (2006.01)
*D03D 23/00* (2006.01)

(52) U.S. Cl. ..... 139/21; 139/37; 139/116.5; 139/102

(58) Field of Classification Search ..... 139/21, 139/37, 116.5, 102
See application file for complete search history.

(56) References Cited

U.S. PATENT DOCUMENTS 3,943,981 A 3/1976 DeBrander
6,293,314 B1 * 9/2001 Dewispelaere ..... 139/2
6,817,383 B2 * 11/2004 Debaes et al. ..... 139/21
6,837,274 B2 * 1/2005 Debaes et al. ..... 139/21
6,945,280 B2 * 9/2005 Debaes ..... 139/21
7,086,424 B2 * 8/2006 Debaes et al. ..... 139/418
7,089,967 B2 * 8/2006 Debaes ..... 139/37
7,111,647 B2 * 9/2006 Debaes ..... 139/21
7,117,897 B2 * 10/2006 Debaes ..... 139/21
7,134,401 B2 * 11/2006 Debaes et al. ..... 116/21
7,240,698 B2 * 7/2007 Debaes ..... 139/37
7,287,552 B2 * 10/2007 Debaes et al. ..... 139/21
7,395,839 B2 * 7/2008 Debaes ..... 139/21

FOREIGN PATENT DOCUMENTS

EP 1152076 11/2006

* cited by examiner

*Primary Examiner*—Bobby H Muromoto, Jr.
(74) *Attorney, Agent, or Firm*—James Creighton Wray; Meera P. Narasimhan

(57) ABSTRACT

A weaving method and a fabric (1, 2) woven by the present method includes a ground fabric (100, 200) composed of ground warp yarns, one or more binding warp yarns (101, 201), first weft yarns (3) and second weft yarns (4*a*, 4*b*, 4', 4") which are tied up in the ground fabric. Additionally, one or more tension warp yearns (102, 202) and non-figure forming and/or figure forming pile warp yarns (6, 7), with figure forming pile warp yarns (6) form figure-forming pile burls (6*a*, 6*b*). At least one set of two successive figure forming pile burls (6*a*, 6*b*) in the warp direction are alternately tied up over the first weft yarn (3). The first weft yarn is situated on the back of the fabric (1, 2) outside the ground fabric (100, 200), and over the second weft yarn (4*a*, 4*b*, 4', 4").

32 Claims, 5 Drawing Sheets

METHOD FOR WEAVING A FABRIC AND FABRIC WOVEN ACCORDING TO SUCH A METHOD

Firstly, the invention relates to a method for weaving a fabric, comprising a ground fabric which is composed of ground warp yarns, comprising one or more binding warp yarns and second weft yarns which are tied up in the ground fabric;

one or more tension warp yarns;

figure forming and/or non-figure forming pile warp yarns, with the figure forming pile warp yarns forming figure forming pile burls.

Secondly, the invention relates to a fabric, comprising a ground fabric which is composed of ground warp yarns, comprising one or more binding warp yarns and second weft yarns which are tied up in the ground fabric;

one or more tension warp yarns;

non-figure forming and/or figure forming pile warp yarns, with the figure forming pile warp yarns being provided in order to form figure forming pile burls.

Hand-knotted fabrics, e.g. carpets, are characterized by high density;

intricate patterns;

pure back with no ground warp yarns showing.

For the production of a hand-knotted fabric, a number of warp yarns are arranged vertically next to one another between a warp beam for the supply of warp yarns and a cloth winder for winding the knotted fabric onto. The warp yarns are tensioned between these two.

When knotting by hand, the knotter knots pile yarns around the warp yarns horizontally, usually tying the knot over two adjacent warp yarns (as illustrated in "Die Teppichindustrie", Hans Oswald, 1965, Meliand Textilberichte, Heidelberg, pp. 174 and 175). When a complete row of knots has been tied horizontally, one or more weft yarns are inserted between the warp yarns and the weft yarn(s) is (are) pressed against the knots using a reedshaft, which knots are in turn pressed against the fabric which has already been formed. Subsequently, the knotter can start on a new row of knots and repeat the procedure.

As can be seen in the figures, the warp yarns are completely surrounded by the knotted pile, which means that the latter cover the warp yarns on the back. If the rows of knots are pressed together firmly, which is necessary in order to produce a high-quality knotted fabric with good pile strength, no ground warp yarns can be seen on the back of the fabric, as a result of which the design of the fabric is very accurate on the back of the fabric as well. Hand-knotted fabrics, e.g. carpets, can be knotted with high densities and a very accurate design.

However, knotting by hand is a very labour-intensive manufacturing method.

Weaving as such, and in particular face-to-face weaving, is a much more productive manufacturing method. However, with these weaving techniques, the pile warp yarns are tied up over weft yarns which, in the most advantageous case, extend at the back of the fabric with respect to a tension warp yarn, and the warp yarns are to a large degree visible on the back of the fabric, because these tie up the weft yarns, also those on the back of the fabric, in the ground fabric. The back of such fabrics therefore also has a totally different appearance to that of the back of a knotted carpet.

It is an object of the invention firstly to provide a method for weaving a fabric according to the preamble of the first claim, wherein the quality of the back of the fabric approaches the quality of a hand-knotted fabric and wherein high densities can be achieved in a productive manner.

This object of the invention is achieved by providing a method for weaving a fabric, comprising a ground fabric which is composed of ground warp yarns, comprising one or more binding warp yarns and second weft yarns which are tied up in the ground fabric;

one or more tension warp yarns;

non-figure forming and/or figure forming pile warp yarns, with the figure forming pile warp yarns forming figure forming pile burls, and with at least one set of two successive figure forming pile burls in the warp direction that are alternately tied up over a first weft yarn which is situated on the back of the fabric outside the ground fabric, and over a second weft yarn which is tied up in the ground fabric.

In this manner, a fabric is formed wherein no ground warp yarns are visible on the back of the fabric because the first weft yarns which are outside the ground fabric are tied up on the back of the fabric by pile warp yarns which are usually significantly thicker than the binding warp yarns of the ground fabric. The first weft yarn is in this case outside the ground fabric over the entire width of the fabric;

weft yarns are present in at least 2 layers, i.e. at least 1 layer in the ground fabric and at least 1 layer outside the ground fabric on the back of the fabric;

high pile density can be achieved by tying the pile up over weft yarns which are situated in 2 different layers, as a result of which the pile burls are not just pressed together, but partially overlap one another in the warp direction of the fabric.

In a preferred method according to the invention, the weft yarns are positioning in at least 2 layers in the fabric.

In a preferred method according to the invention, the at least one set of two successive pile burls in the warp direction is alternately formed over a first weft yarn and over a second weft yarn with the successive pile burls being formed using the same pile warp yarn.

In this manner, the pattern on the back corresponds to the pattern on the pile side, with, in a spot in the pattern where the method of the invention is applied, one point on the back corresponds to two pile burls (=four pile legs) on the pile side. This means that at that spot in the fabric weaving takes place in a ratio 2 for each point in the design pattern two pile burls are used, both of which are visible on the pile side and only one of which is visible on the back. The other pile burl is not visible on the back because it is tied up over a second weft yarn in the ground fabric, which is covered by the first pile burls which are outside the ground fabric since said weft yarns will partially be on top of one another due to the structure of the fabric using weft yarns in layers.

In a preferred embodiment of a method according to the invention, the second weft yarns are divided into first second weft yarns on the pile side of the ground fabric, and second second weft yarns on the back of the ground fabric, with a tension warp running between the first second weft yarns on the pile side and the second second weft yarns on the back of the fabric.

The second weft yarns over which pile burls are tied up may, on the one hand, be first second weft yarns on the pile side.

Thus, these pile burls are covered to a greater degree from the back of the fabric on their back, and the pile burls can more easily overlap in several layers in the warp direction so that higher densities can be achieved. As a result of a higher density, the pile burls around the first weft yarns outside the ground fabric are pressed together more firmly so that the ground warp yarns are even less visible through the pile burls. The combination of densely woven pile burls which tie up over first weft yarns outside the ground fabric which make ground warp yarns virtually invisible with pile burls on the pile side at double density gives the fabric, for example a carpet, an appearance which closely resembles that of a knotted fabric.

However, the second weft yarns over which pile burls are tied up may also be second second weft yarns on the back.

In an advantageous embodiment of a method according to the invention, the non-figure forming pile warp yarns are tied up as dead pile between the first second weft yarns on the pile side and the second second weft yarns on the back.

Preferably, the non-figure forming pile warp yarns are situated between the tension warp yarns and the first second weft yarns on the pile side.

This position of the tension warp yarns makes the dead pile on the back of the fabric even less visible.

The non-figure forming pile warp yarns may float on the pile side, and are only occasionally tied up over a second weft yarn.

The second weft yarn may in this case be a first second weft yarn which is on the pile side, with the dead pile being less visible from the back, but may also be a second second weft yarn which is on the back, which results in an improved fastening of the non-figure forming pile.

The non-figure forming pile warp yarns may successively be tied in as dead pile and in a zone where no pile is formed, float over first second weft yarns on the pile side in order thus to form figure in the ground fabric on the surface of the ground fabric.

In order to increase the accuracy on the back and to increase the pile strength, the yarns used for the first weft yarns may be thicker than those used for the second weft yarns.

In order to also increase the pile strength of the pile which is not tied up on the back of the fabric, the second weft yarns around which pile warp yarn is tied up may be thicker yarns than the second pile warp yarns around which no pile warp yarn is tied up.

In a first advantageous embodiment of a method according to the invention, two weft-insertion means are inserted simultaneously at different weft-insertion levels during the insertion of the weft yarns.

In a second advantageous embodiment of a method according to the invention, at least three weft-insertion means are inserted simultaneously at different weft-insertion levels during the insertion of the weft yarns.

In a preferred embodiment of a method according to the invention, lancets may be used during the face-to-face weaving for keeping the two fabrics at a distance, which makes it possible to reduce the tension to which the pile warp yarns are subjected during weaving. This is particularly advantageous if two weft yarns are inserted simultaneously.

With the method according to the invention, the rapiers which insert the first weft yarns, which are not tied up by the warp yarns of the ground fabric, in the bottom fabric during their movement through the shed are not supported by yarns. With the method according to the present invention, the binding warp yarns which, in the prior art weaving processes, support these rapiers in their movement through the shed are situated above these rapiers. The pile warp yarns which will be tied up are indeed situated below these bottom rapiers, but at a level which is too low to guide the rapiers, because, with other weft-insertion cycles, the binding warp yarns are situated below the bottom rapiers, and a separation in the level between binding warp yarns and pile warp yarns is highly desirable. The fact is that a systematic crossing of these two groups of warp yarns is very detrimental to the weaving process. Without such guidance, the bottom rapiers cannot take the first weft yarn through the shed or transfer it in the central position in a reliable manner.

In order to solve this problem, the pile warp yarns which are tied up over the first weft yarns are lifted to a position which, relative to the position of the weaver, is located behind the rapiers which insert the weft yarns, this position being chosen in such a manner that, at the bottom rapiers, these pile warp yarns are positioned just below these bottom rapiers, and perform a guiding function for these bottom rapiers during their movement through the shed.

Such positioning may be effected by

- using a weaving frame having a number of healds which are provided with heald eyes, a cord, wire or bar extending through several or all heald eyes of this weaving frame in the weft direction, and this weaving frame being lifted for the insertion of the first weft yarns in such a manner that the cord, wire or bar takes the figure forming pile warp yarns which are situated below the bottom rapiers to just below these rapiers;
- dimensioning at least one weaving frame for driving the binding warp yarns in the top fabric in such a manner that, when these binding warp yarns are in their highest position above the top rapier, a cord, wire, bar or beam which extends in the weft direction and is connected to this weaving frame, lifts the pile warp yarns which are in the bottom position along in order to position them just below the bottom rapier;
- using at least one weaving frame which is driven by a servomotor, the vertical movement of the weaving frame being controllable and programmable, as a result of which this weaving frame with binding warp yarns which is situated above the top rapier at the point in time when the bottom rapier has to be supported, is lifted slightly higher than is required for shed-forming of the binding warp yarns, so that the bottom beam of the weaving frame lifts the pile warp yarns which are in the bottom position along in order to position them just below the bottom rapier;
- using a reciprocating weaving frame or a reciprocating table which is provided at the top with a surface which positions said pile warp yarns just below the bottom rapiers;
- using a fixed table which always positions said pile warp yarns just below the bottom rapier. Said fixed table is in this case preferably positioned as closely as possible to the rapiers in order to keep the zone wherein the pile warp yarns and binding warp yarns meet as short as possible positions where there are also binding warp yarns below the bottom rapiers.

It is another object of the invention to provide a fabric comprising

- a ground fabric which is composed of ground warp yarns, comprising one or more binding warp yarns and second weft yarns which are tied up in the ground fabric;
- one or more tension warp yarns;
- non-figure forming and/or figure forming pile warp yarns, with figure forming pile warp yarns forming figure forming pile burls, wherein the quality of the back of the fabric approaches the quality of a hand-knotted fabric.

This object of the invention is achieved by providing a fabric, comprising

- a ground fabric which is composed of ground warp yarns, comprising one or more binding warp yarns and second weft yarns which are tied up in the ground fabric;

one or more tension warp yarns;

non-figure forming and/or figure forming pile warp yarns, with figure forming pile warp yarns forming figure forming pile burls, wherein at least one set of two successive figure forming pile burls in the warp direction are alternately tied up over a first weft yarn which is situated on the back of the fabric outside the ground fabric, and over a said second weft yarn.

This method has the advantage that a figure forming pile warp yarn can form pile during each machine cycle in one of the two fabrics, as a result of which this method achieves a high degree of productivity.

The fabric according to the invention is preferably woven in accordance with a method according to the invention as described above.

Fabric structures according to the invention can be manufactured in a 1/2V pile weave, wherein one pile burl is provided in each fabric for every 2 weft yarns inserted per fabric.

Furthermore, the fabric may be manufactured in a 1+1/2V pile weave by using a 1/2 V weave in combination with a ground weave in repeat 8, wherein per set of 4 weft yarns per fabric 1 second weft yarn on the pile side of the fabric is not inserted. This notation indicates a fabric structure with a continuous alteration between 1/1V and 1/2V for every 2 machine cycles.

Such a fabric structure allows higher densities, as there are fewer weft yarns present in the fabric while the strength of the ground fabric is not compromised. This method shows similarities with the method as described in EP 1 152 076, but has the following distinct differences:

in EP 1152076, there are no first weft yarns which are not tied up in the ground fabric;

in EP 1152076, there are no pile warp yarns which are tied up over weft yarns on the pile side of the fabric.

In a preferred fabric according to the invention, the fabric is manufactured in a 2/3+1/1 V pile weave by means of a weaving device having three weft-insertion means with a ground weave in repeat 8, wherein, over 4 weft-insertion cycles, 2 weft yarns are not inserted, in particular a first second weft yarn which, if it were to be inserted, would be on the back of the fabric, and a second second weft yarn which, if it were to be inserted, would be on the pile side of the fabric. In this case, the 1/1 section ties up pile weave over a second weft yarn which is situated on the back of the fabric, thus increasing the pile strength. It should be pointed out here that a 2/3+1/1 V-weave can also be referred to as a 2/2+1/2 V-weave, depending on how the weft yarns are grouped per fabric in the expression.

Even if a second weft yarn, which would be on the back of the fabric, were again to be selected as second non-inserted second weft yarn, a 2/3+1/1V pile weave is achieved, with the section 1/1 tying up pile weave over a second weft yarn on the pile side of the fabric, thus making a higher fabric density and a better quality of the back of the carpet possible as the weft yarns on the pile side and the back are sufficiently far apart for the resulting plurality of layers of weft yarns to be pressed together in a more compact way.

Both fabric structures with strong ground fabric also allow higher densities because there are fewer weft yarns.

A further preferred embodiment comprises in leaving out the weft yarn which is situated on the pile side between the pile burl in the 2/3V section in the abovementioned 2/3+1/1V pile weaves. This again frees up space in the fabric which can be used to increase the weaving density. Thus, a 1+1/2 V pile weave is achieved using the three-rapier technique, the advantages of which have already been discussed above. Applying this fabric structure on a three-rapier weaving machine offers the advantage that the non-figure forming pile warp yarns do not have to move when they are used as non-figure forming dead pile warp yarns, so that, particularly when weaving at higher densities, and more specifically at a higher number of pile warp yarn systems, the weaving process runs much more smoothly and the back of the fabric is nicer since fewer pile warp yarns protrude from the ground fabric on the back. Moving non-figure forming dead pile warp yarns lead to higher consumption of pile warp yarns which in turn leads to pile warp yarns protruding from the back of the fabric.

All the above high-density methods can very advantageously be applied in combination with the method according to EP 1 347 086, which describes how a weaving device for weaving at a high fabric density is achieved by providing, in a weaving device for normal fabric density (e.g. reed 320 or 350), at least 2 pile warp yarn systems together with ground warp yarns which are distributed over the two warp yarn systems within the same reed dent and not all ground warp yarns being doubled between every 2 reed dents. Thus, for example, the binding warp yarns can be used in such a manner that two binding warp yarns which are positioned in such a manner with respect to the (second) weft yarns that they form a ground fabric which comprises these (second) weft yarns, with one binding warp yarn being coupled to the first pile warp yarn system and the second binding warp yarn being coupled to the other pile warp yarn system within the same reed dent.

The method 1+1/2V with a three-rapier weaving device has the drawback that, because no spacers are used to keep the top and bottom fabric at the desired distance apart, when pile warp yarns are tied up over first second weft yarns which are on the pile side of the fabric, these pile warp yarns have to be pulled through binding warp yarns in order to achieve the desired distance between the two fabrics. For pile warp yarns which are tied up over first second weft yarns on the pile side of the fabric, the tension warp yarns supply a large part of the force required to keep the fabrics the desired distance apart.

As the binding warp yarns are under a lower tension than the tension warp yarns, the former therefore supply a smaller force for keeping the fabrics at a distance from one another. When weaving fabrics in high density, especially with a significant number of pile warp yarn systems, this may be a limitation.

In order to solve this problem, a further preferred method provides that the formation per fabric in at least one pile warp yarn system of at least one set of two successive figure forming pile burls in the warp direction by alternately tying these up, in said fabric, over a first weft yarn which is on the back of the fabric, outside the ground fabric, and over a second weft yarn which is tied up in the ground fabric in the warp direction is preceded or followed by two successive pile burls in said fabric which are only tied up over first weft yarns while the same succession of pile burls in the fabric occurs in an adjacent warp yarn system, with said figure forming pile burls which tie up over second weft yarns do not tie up over the same second weft yarns in the two adjacent warp yarn systems In this case, a pile burl is no longer formed in each pile warp yarn system during each machine cycle in one of the two fabrics, but still 6 pile burls during 8 machine cycles which is still quite a high figure for a fabric of this quality at high pile warp yarn systems densities.

The fabric according to the invention can be woven according to the single-side or the face-to-face weaving method.

The present invention will now be discussed in greater detail by means of the following detailed description of a fabric structure, woven in accordance with a method according to the invention. The aim of this description is solely to give an illustrative example and to indicate further advantages and features of this invention and should therefore not be interpreted as limiting the area of application of the invention or of the patent rights claimed in the claims.

Reference numerals are used in this detailed description which refer to the attached drawings, wherein FIG. 1 shows a fabric structure according to the invention having tied-in non-figure forming pile warp yarns, and which is woven according to the face-to-face weaving method;

Figure 6A:
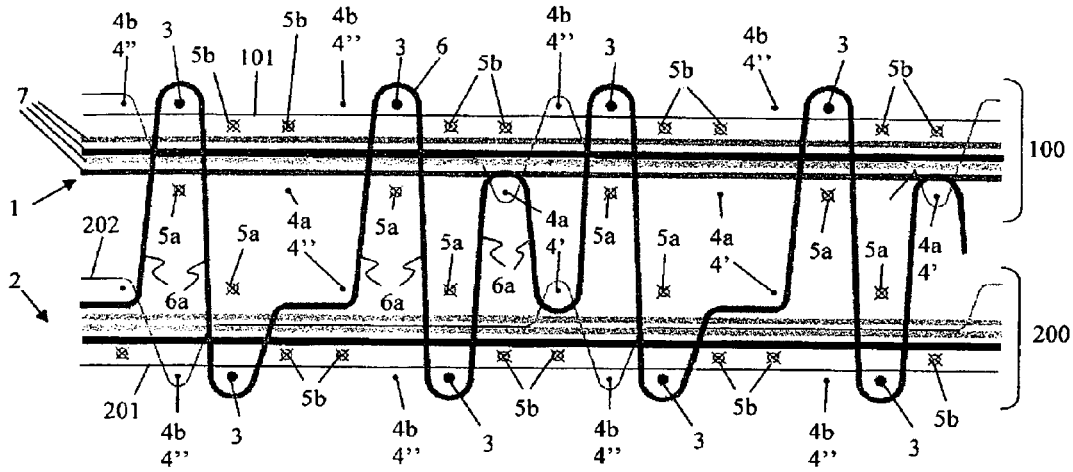
Figure 6B:
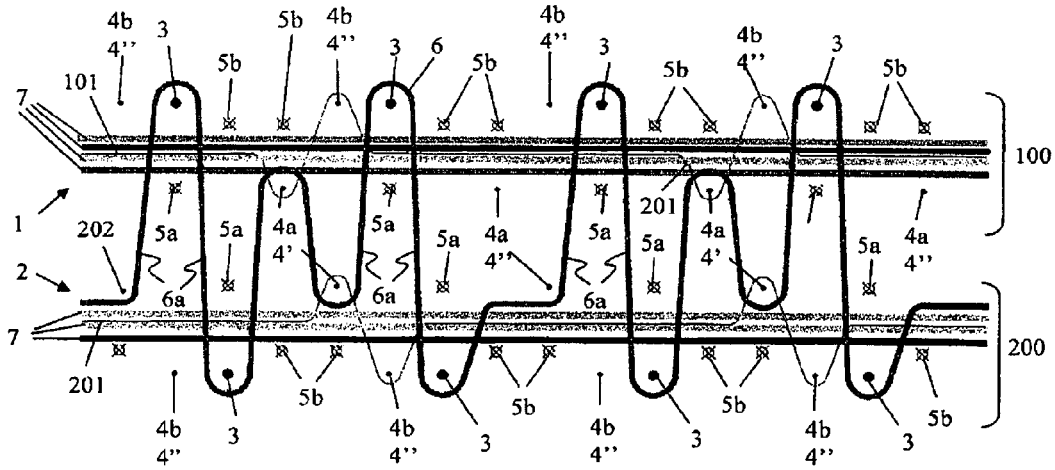
Figure 7A:
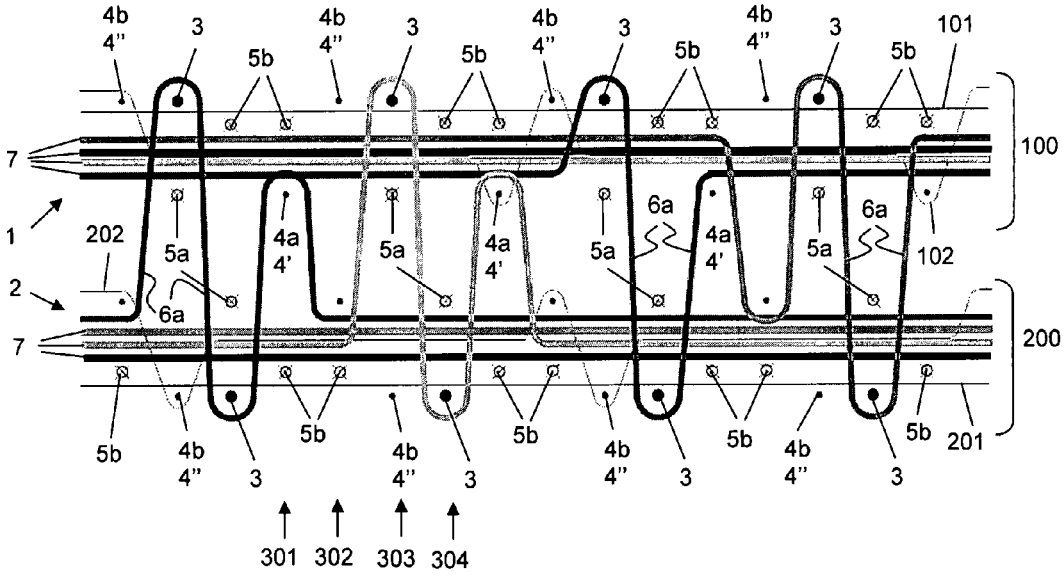
Figure 7B:
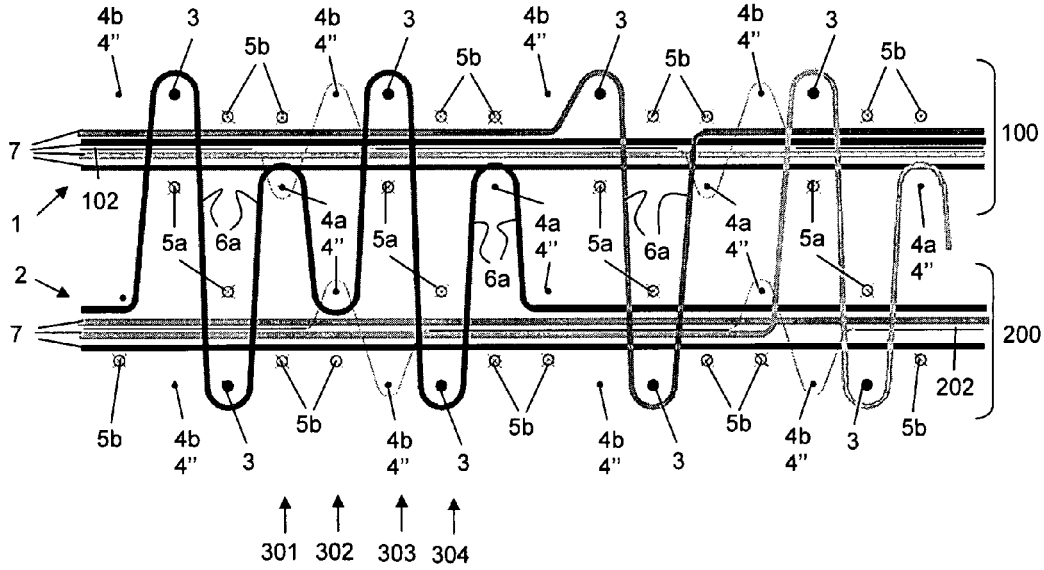

FIGS. 6*a* and 6*b* show two adjacent pile warp yarn systems of a fabric structure according to the invention which are woven according to a 1+1/2 V-weave by means of a weaving machine with three weft-insertion means wherein two pile warp yarn systems are situated in the same reed dent;

FIGS. 7*a* and 7*b* show two adjacent pile warp yarn systems of a fabric structure woven in accordance with a particular method according to the invention by means of a weaving machine with three weft-insertion means, wherein two pile warp yarn systems are situated in the same reed dent.

With one method for weaving of a fabric (1, 2) according to the invention, wherein the fabric (1, 2), mainly on the back, has the appearance of a hand-knotted fabric, a ground fabric (100, 200) is made from ground warp yarns, comprising one or more binding warp yarns (101, 201), second weft yarns (4*a*, 4*b*, 4', 4") which are tied up in the ground fabric (100, 200), and one or more tension warp yarns (102, 202), as is illustrated in FIGS. 1 to 9. Furthermore, the fabric (1, 2) comprises first weft yarns (3) which are on the back outside the ground fabric and non-figure forming and/or figure forming pile warp yarns (6, 7), the figure forming pile warp yarns (6) forming figure forming pile burls (6*a*, 6*b*), with at least one set of two successive figure forming pile burls (6*a*, 6*b*) in the warp direction alternately being tied up over a first weft yarn (3) which is on the back of the fabric (1, 2) outside the ground fabric (100, 200), and over a second weft yarn (4*a*, 4*b*, 4', 4") which is tied up in the ground fabric (100, 200). The weft yarns (3, 4) are in this case preferably laid in at least two layers.

The fabrics (1, 2), as illustrated in FIGS. 1 to 7, are woven according to the face-to-face weaving method. However, these fabrics (1, 2) may also be woven according to the single-side weaving method.

As can be seen in FIGS. 1 to 9, preferably each set of two successive pile burls (6*a*, 6*b*) in the warp direction is alternately formed over a first weft yarn (3) and over a second weft yarn (4*a*, 4*b*, 4', 4"), and using the same pile warp yarns (6). The second weft yarns which are tied up in the ground fabric (100, 200) by weave and tension warp yarns (101, 201, 102, 202) can be divided into first second weft yarns (4*a*) on the pile side of the ground fabric (100, 200);

second second weft yarns (4*b*) on the back of the ground fabric (100, 200).

With the fabrics illustrated in FIGS. 1 to 5, the second weft yarns (4*a*, 4*b*, 4', 4") are tied up by two binding warp yarns (101, 201) and one tension warp yarn (102, 202) per warp yarn system while with the fabrics illustrated in FIGS. 6*a*, 6*b*, 7*a* and 7*b*, the second weft yarns (4*a*, 4*b*, 4', 4") are tied up by one binding warp yarn (101, 201) and one tension warp yarn (102, 202) per warp yarn system. A tension warp yarn (102, 202) is situated between the first second weft yarns (4*a*) on the pile side and the second second weft yarns (4*b*) on the back.

Figure 1:
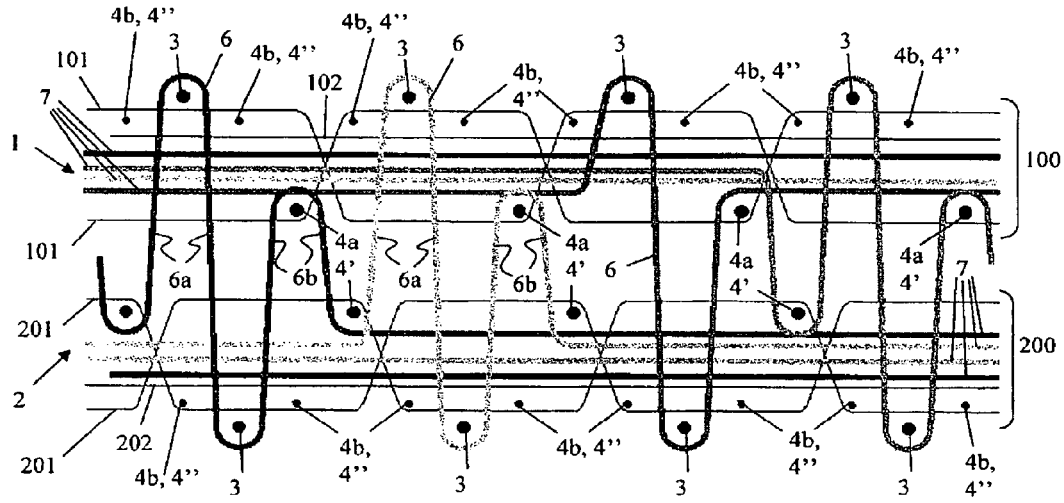
Figure 2:
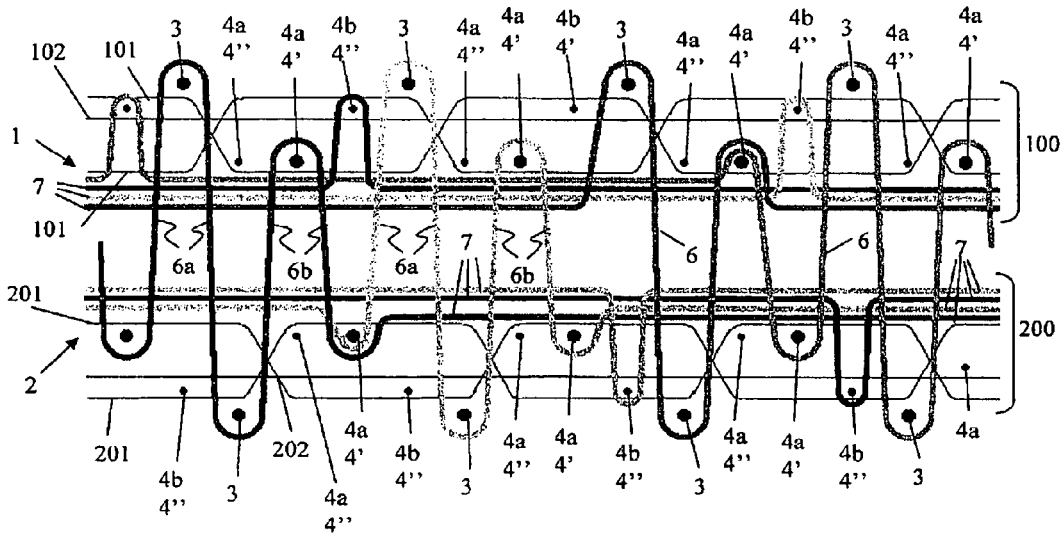
FIG. 2 shows a fabric structure according to the invention with floating non-figure forming pile warp yarns on the pile side which are regularly tied up over a second weft yarn which is on the back, and which is woven according to the face-to-face weaving method.
Figure 3:
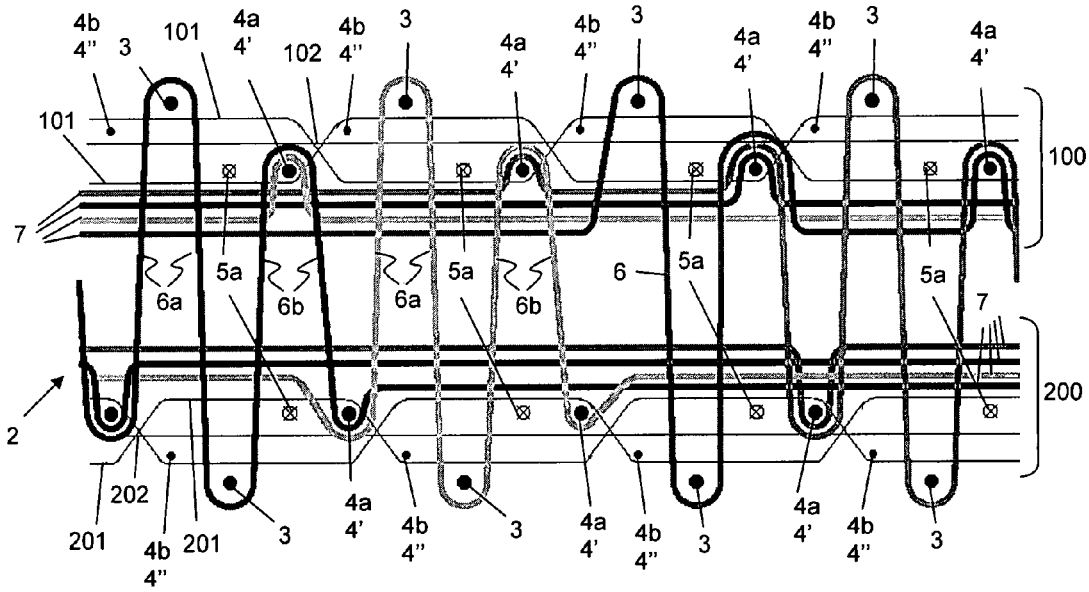
FIG. 3 shows a fabric structure according to the invention with floating non-figure forming pile warp yarns on the pile side which are regularly tied up over a second weft yarn which is on the pile side, and which is woven according to the face-to-face weaving method.

Preferably, the second weft yarns over which the pile burls (6*a*, 6*b*) are tied up are first second weft yarns (4*a*) on the pile side of the ground fabric (100, 200) (see FIGS. 1 to 3). Nevertheless, the second weft yarns over which pile burls (6*a*, 6*b*) are tied up may also be second second weft yarns (4*b*) on the back of the ground fabric (100, 200).

Figure 4:
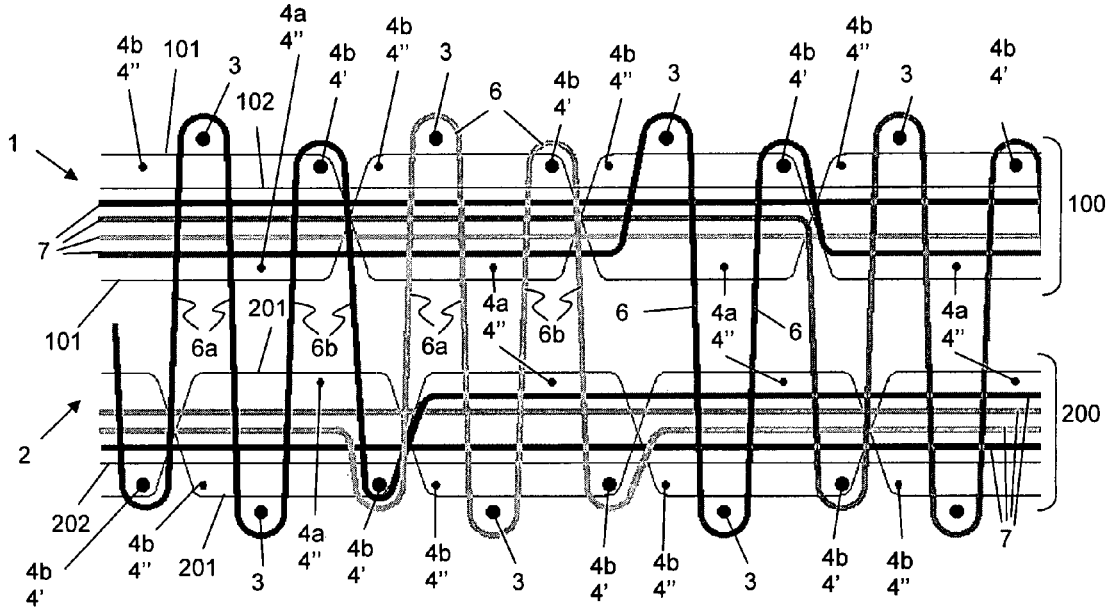
FIG. 4 shows a fabric structure according to the invention wherein some of the pile warp yarns are tied up over a second weft yarn on the back of the fabric, and which is woven on a weaving machine with two weft-insertion means and according to the face-to-face weaving method.
Figure 5:
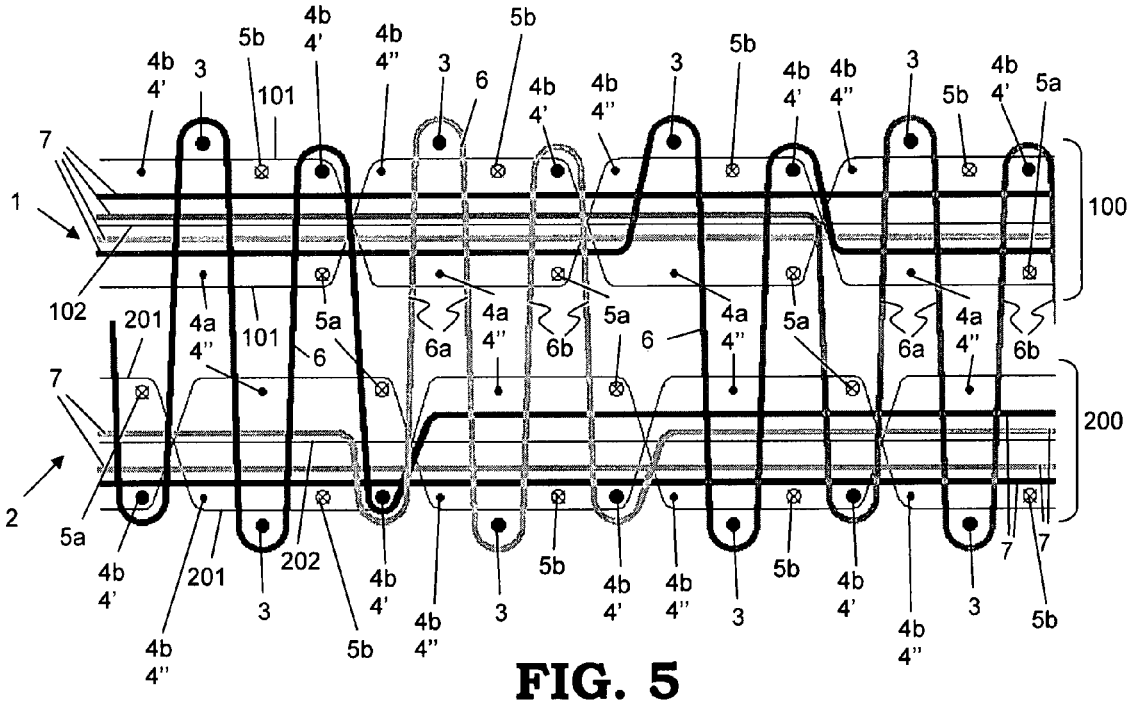
FIG. 5 shows a fabric structure according to the invention wherein some of the pile warp yarns are tied up over a second weft yarn on the back of the fabric, and which is woven on a weaving machine with three weft-insertion means according to the face-to-face weaving method.

As illustrated in FIGS. 1, 4 and 5, the non-figure forming pile warp yarns (7) can be tied up as dead pile between the first second weft yarns (4*a*) on the pile side of the ground fabric (100, 200) and second second weft yarns (4*b*) on the back of the ground fabric (100, 200). As can be seen in FIGS. 1 and 4, the non-figure forming pile warp yarns (7) are preferably between the tension warp yarn (102, 202) and the first second weft yarns (4*a*) on the pile side of the ground fabric (100, 200).

As illustrated in FIGS. 2 and 3, the non-figure forming pile warp yarns (7) may float on the pile side, and only occasionally be tied up over a second weft yarn (4*a*, 4*b*, 4', 4"). In FIG. 2, this second weft yarn is a second second weft yarn (4*b*) on the back of the ground fabric (100, 200), while in FIG. 3, this second weft yarn is a first weft yarn (4*a*) on the pile side of the ground fabric (100, 200).

The non-figure forming pile warp yarns (7) can successively be tied in as dead pile and float over first second weft yarns (4*a*) on the pile side in a zone where no pile is formed, in order to form figure in the ground fabric (100, 200) at the surface of the ground fabric (100, 200) (not illustrated in the figures).

As illustrated in FIGS. 1 to 5, the yarns used for the first weft yarns (3) are preferably thicker than those used for the second weft yarns (4*a*, 4*b*, 4', 4"). Preferably, the second weft yarns (4') around which pile warp yarn (6) is tied up are thicker yarns than the second weft yarns (4") around which no pile warp yarn (6) is tied up.

With the method according to the invention, during the insertion of weft yarns (3, 4*a*, 4*b*, 4', 4"), two weft-insertion means (3, 4*a*, 4*b*, 4', 4") can be inserted simultaneously at different weft-insertion levels, as is illustrated in FIGS. 1 to 4. However, as is shown in FIGS. 5 to 9, it is also possible to insert at least three weft-insertion means (3, 4*a*, 4*b*, 4', 4") simultaneously during the insertion of weft yarns (3, 4*a*, 4*b*, 4', 4").

Fabric structures according to the invention can be produced using a 1/2V pile weave (see FIGS. 1, 2 and 4), with one pile burl (6*a*, 6*b*) being provided in each fabric (1, 2) for every 2 weft yarns (3, 4*a*, 4*b*, 4', 4") inserted per fabric.

Furthermore, as shown in FIG. 3, the use of the 1/2V fabric structure on a two-rapier weaving machine in combination with, for example, a ground weave in repeat 8, makes it impossible to insert one second weft yarn (5*a*) on the pile side of the fabric per series of 4 weft yarns (3, 4*a*, 4*b*, 4', 4") per fabric, so that a 1+1/2V fabric structure (fabric structure with continuous alteration between 1/1V and 1/2V in each fabric per 2 machine cycles) is produced, as can be seen in FIG. 3.

The fabric structure illustrated in FIG. 5 is achieved using a weaving device with three weft-insertion means with a ground weave in repeat 8, with 2 second weft yarns (5*a*, 5*b*) not being inserted over 4 weft-insertion cycles, i.e. a first second weft yarn (5*b*) which, if it were inserted, would be on the back of the fabric (1, 2), and a second second weft yarn (5*a*) which would be on the pile side of the fabric (1, 2). In this manner, a 2/3+1/1V pile weave is produced.

Even if a second weft yarn (5*b*), which would be on the back of the fabric, were again to be used as second non-inserted second weft yarn, a 2/3+1/1V pile weave is achieved (not illustrated in the figures), with the section 1/1 tying up V-pile weave over a first second weft yarn (5*a*) on the pile side of the fabric, thus making a higher fabric density and a better quality of the back of the carpet possible as the weft yarns on the pile side and the back are sufficiently far apart for the resulting plurality of layers of weft yarns (3, 4*a*, 4*b*, 4', 4") to be pressed together in a more compact way.

The fabrics (1, 2), as illustrated in FIGS. 1 to 5, are shown in weave repeat 8, but it is obvious that other weave repeats can also be used. Thus, for example, all multiples of 4 can be selected as weave repeat.

As is illustrated in FIGS. 6*a* and 6*b*, with the abovementioned 2/3+1/1V pile weave, the weft yarn (5*a*) which is situated on the pile side between the pile burl (6*a*, 6*b*) can be omitted in the 2/3V section, freeing up some space in the fabric (1, 2), as has already been indicated above, which may be used to increase the fabric density, and producing a 1+1/2 V-weave by means of the three-rapier weaving technique resulting in the advantages which have already been described above (advantage already indicated in the introductory text of the description).

Furthermore, during weaving of the fabrics (1, 2), as illustrated in FIGS. 6*a* and 6*b*, and as is the case with the method described in EP 1 347 086, two warp yarn systems can be in the same reed dent, and in each warp yarn system only one binding warp yarn (101) per fabric (1, 2) can be present, with the two binding warp yarns (101) of the same fabric (1, 2) tying up all second weft yarns (4*a*, 4*b*) from the two different warp yarn systems in the ground fabric. The second second weft yarns (4*b*) which are on the back of the ground fabric with respect to the tension warp yarn (102, 202) and are not tied up by a binding warp yarn (101, 201) in their warp yarn system are in this case not visible on the back of the fabric (1, 2) since they are hidden under the pile warp yarns (6, 7) which are pressed closely together and tie up on the back around the first weft yarns (3). This method produces very dense fabrics (1, 2), the backs of which have an appearance which is similar to that of hand-knotted carpets, with each point on the back having two corresponding pile burls (6*a*, 6*b*) on the pile side.

In order to solve the abovementioned problem regarding tension of the binding warp yarns (101, 201) used in the method for weaving fabrics (1, 2) as illustrated in FIGS. 6*a* and 6*b*, the formation in at least one pile warp yarn system of at least one set of two successive figure forming pile burls (6*a*, 6*b*) in the warp direction by alternately tying these up over a first weft yarn (3) which is on the back of the fabric (1, 2) outside the ground fabric (100, 200) and over a second weft yarn (4*a*, 4*b*, 4', 4") which is tied up in the ground fabric (100, 200), as illustrated in FIGS. 7*a* and 7*b*, is preceded or followed by two successive pile burls (6*a*, 6*b*) within the same fabric (1, 2) which are only tied up over first weft yarns (3), while the same succession of pile burls (6*a*, 6*b*) occurs in an adjacent pile warp yarn systems, with a second weft yarn (4*a*, 4*b*, 4', 4") which is tied up in these pile warp yarn systems by a pile warp yarn (6) being tied up by only one pile warp yarn (6) in these pile warp yarn systems.

As can be seen in FIGS. 7*a* and 7*b*, with FIG. 7*a* showing a first pile warp yarn system and FIG. 7*b* showing a second adjacent pile warp yarn system, a first second weft yarn (4*a*) is tied up in the top and the bottom fabric, respectively, by a pile warp yarn (6) in the second pile warp yarn system during a first and a second machine cycle (301, 302), while during the same machine cycles (301, 302) the second weft yarns (4*a*) are not tied up by a pile warp yarn (6) in the first pile warp yarn system. However, during the following third and fourth machine cycles (303, 304), a first second weft yarn (4*a*) is tied up in the top and bottom fabric, respectively, by a pile warp yarn (6) in the first pile warp yarn system, while during the same machine cycles (303, 304) the second weft yarns (4*a*) are not tied up by a pile warp yarn (6) in the second pile warp yarn system.

In this case, a pile burl (6*a*, 6*b*) is no longer formed in each pile warp yarn system during each machine cycle in one of the two fabrics (1, 2), but still 6 pile burls are formed during 8 machine cycles which is still quite a high figure for a fabric (1, 2) of this quality at high pile warp yarn system densities.

Also when working according to the methods using two pile warp yarn systems per reed dent, as illustrated in FIGS. 6*a*, 6*b*, 7*a* and 7*b*, some colours of the pile warp yarns (6, 7) may differ between the two pile warp yarn systems. As a result, when selecting one of these colours for pile-forming, only a halve density is achieved in the weft direction compared to the pile-forming by pile warp yarns (6, 7) which are present in each of the pile warp yarn systems. This halving in pile density can substantially be compensated for by working according to the invention in those areas in the fabric, so that a double density is produced in said areas in the warp direction, as a result of which the density in the fabric corresponds to the density of the pile warp yarns (6, 7) which are present in each of the pile warp yarn systems and which are only tied up over first weft yarns (3).

Furthermore, it is preferable if the figure forming pile burls (6*a*) start forming figure at colour transitions and end figure forming by tying up over first weft yarns (3). This then means that between the end of the figure-forming by the one pile warp yarn (6) and the start of the figure-forming by the other pile warp yarn (6), no pile warp yarns (6) are tied up in a figure-forming way over the intermediate second weft yarns (4*a*, 4*b*, 4', 4").

This results in a limited loss of figure forming pile burls (6*a*), but does offer a more accurately defined pattern on the pile side, because mixing contours are thus avoided.

Furthermore, one advantage of the invention as described here is the fact that with using one and the same fabric design pattern fabrics of different densities can be produced for the same pattern by means of different processing:

- single density if the pile warp yarns (6) are tied up only over the first weft yarns (3);
- double density if the pile warp yarns (6) in between are in each case also tied up over a second weft yarn (4*a*, 4*b*, 4', 4");
- one and a half density if, as described, if two adjacent pile warp yarn systems are made different but also numerous other varying densities in between.

With the method according to the invention, the pile warp yarns (6) which are tied up over a first weft yarn (3) are lifted to a position which, relative to the position of the weaver, is located behind the rapiers which insert the weft yarns (3), this position being chosen in such a manner that, at the bottom rapiers, these pile warp yarns (6) are positioned just below these bottom rapiers, and perform a guiding function for these bottom rapiers during their movement through the shed.

Such positioning may be effected by using a weaving frame having a number of healds which are provided with heald eyes, a cord, wire or bar extending through several or all heald eyes of this weaving frame in the weft direction, and this weaving frame being lifted for the insertion of the first weft yarns in such a manner that the a cord, wire or bar takes the figure forming pile warp yarns (6) which are situated below the bottom rapiers to just below these rapiers;

dimensioning at least one weaving frame for driving the binding warp yarns in the top fabric in such a manner that, when these binding warp yarns are in their highest position above the top rapier, a cord, wire, bar or beam which extends in the weft direction and is connected to this weaving frame, lifts the pile warp yarns (6, 7) which are in the bottom position along in order to position them just below the bottom rapier;

using at least one weaving frame which is driven by a servomotor, the vertical movement of the weaving frame being controllable and programmable, as a result of which this weaving frame with binding warp yarns (101, 201) which is situated above the top rapier at the point in time when the bottom rapier has to be supported, is lifted slightly higher than is required for shed-forming of the binding warp yarns (101, 201), so that the bottom beam of the weaving frame lifts the pile warp yarns (6) which are in the bottom position along in order to position them just below the bottom rapier;

using a reciprocating weaving frame or a reciprocating table which is provided at the top with a surface which positions said pile warp yarns (6) just below the bottom rapiers;

using a fixed table which always positions said pile warp yarns (6) just below the bottom rapier, said fixed table being in this case preferably positioned as closely as possible to the rapiers in order to keep the zone wherein the pile warp yarns (6) and binding warp yarns (101, 201) meet as short as possible in positions where there are also binding warp yarns (101, 201) below the bottom rapier.

The method according to the invention can in particular be used for carpets, but other applications are also possible.

The invention claimed is:

1. Method for weaving a fabric (1, 2), comprising first weft yarns (3) and second weft yarns (4*a*, 4*b*, 4', 4");

a ground fabric (100, 200) which is composed of ground warp yarns, comprising one or more binding warp yarns (101, 201) and said second weft yarns (4*a*, 4*b*, 4', 4") which are tied up in the ground fabric (100, 200);

one or more tension warp yarns (102, 202);

non-figure forming and/or figure forming pile warp yarns (6, 7), wherein with the figure forming pile warp yarns (6) figure forming pile burls (6*a*, 6*b*) are formed;

wherein at least one set of two successive figure forming pile burls (6*a*, 6*b*) in the warp direction are alternately tied up over a said first weft yarn (3) which is situated on the back of the fabric (1, 2) outside the ground fabric (100, 200) over a width of the fabric, and over a said second weft yarn (4*a*, 4*b*, 4', 4").

2. Method according to claim 1, wherein the weft yarns (3, 4) are positioning in at least 2 layers in the fabric (1, 2).

3. Method according to claim 1, wherein the at least one set of two successive pile burls (6*a*, 6*b*) in the warp direction is alternately formed over a first weft yarn (3) and over a second weft yarn (4*a*, 4*b*, 4', 4"), and using the same pile warp yarns (6).

4. Method according to claim 1, wherein the second weft yarns are divided into first second weft yarns (4*a*) on the pile side of the ground fabric (100, 200), and second second weft yarns (4*b*) on the back of the ground fabric (100, 200), with a tension warp yarn (102, 202) running between the first weft yarns (4*a*) on the pile side and the second weft yarns (4*b*) on the back of the fabric (100, 200).

5. Method according to claim 1, wherein the second weft yarns (4') over which pile burls are tied up are first second weft yarns (4*a*) on the pile side.

6. Method according to claim 1, wherein the second weft yarns (4') over which pile burls are tied up are second second weft yarns (4*b*) on the back.

7. Method according to claim 1, wherein the non-figure forming pile warp yarns (7) are tied up as dead pile between the first second weft yarns (4*a*) on the pile side and the second second weft yarns (4*b*) on the back.

8. Method according to claim 7, wherein the non-figure forming pile warp yarns (7) are situated between the tension warp yarns (102, 202) and the first second weft yarns (4*a*) on the pile side.

9. Method according to claim 1, wherein the non-figure forming pile warp yarns (7) float on the pile side, and are only occasionally tied up over a second weft yarn (4*a*, 4*b*, 4', 4").

10. Method according to claim 9, wherein the second weft yarn is a first second weft yarn (4*a*) which is on the pile side.

11. Method according to claim 9, wherein the second weft yarn is a second second weft yarn (4*b*) which is on the back.

12. Method according to claim 1, wherein the non-figure forming pile warp yarns (7) are successively tied in as dead pile and in a zone where no pile is formed, float over first second weft yarns (4*a*) on the pile side in order thus to form figure in the ground fabric (100, 200) on the surface of the ground fabric (100, 200).

13. Method according to claim 1, wherein the yarns used for the first weft yarns (3) are thicker than those used for the second weft yarns (4*a*, 4*b*, 4', 4").

14. Method according to claim 1, wherein the second weft yarns (4') around which pile warp yarn (6) is tied up are thicker yarns than the second weft yarns (4") around which no pile warp yarn (6) is tied up.

15. Method according to claim 1, wherein two weft-insertion means are inserted simultaneously at different weft-insertion levels during the insertion of the weft yarns (3, 4*a*, 4*b*, 4', 4").

16. Method according to claim 1, wherein at least three weft-insertion means are inserted simultaneously at different weft-insertion levels during the insertion of the weft yarns (3, 4*a*, 4*b*, 4', 4").

17. Method according to claim 1, wherein lancets are used during the face-to-face weaving for keeping the two fabrics (1, 2) at a distance.

18. Method according to claim 1, wherein pile warp yarns (6) which are tied up over the first weft yarns (3) are lifted to a position which, relative to the position of the weaver, is located behind the rapiers which insert the weft yarns (3), this position being chosen in such a manner that, at the bottom rapiers, these pile warp yarns (6) are positioned just below these bottom rapiers, and perform a guiding function for these bottom rapiers during their movement through the shed.

19. Method according to claim 18, wherein a weaving frame is used having a number of healds which are provided with heald eyes, a cord, wire or bar extending through several or all heald eyes of this weaving frame in the weft direction, and this weaving frame being lifted for the insertion of the first weft yarns (3) in such a manner that the cord, wire or bar takes the figure forming pile warp yarns (6) which are situated below the bottom rapiers to just below these rapiers.

20. Method according to claim 18, wherein at least one weaving frame for driving the binding warp yarns (101, 201) in the top fabric (1) is dimensioned in such a manner that, when these binding warp yarns (101, 201) are in their highest position above the top rapier, a cord, wire, bar or beam which extends in the weft direction and is connected to this weaving frame, lifts the pile warp yarns (6) which are in the bottom position along in order to position them just below the bottom rapier.

21. Method according to claim 18, wherein at least one weaving frame is used which is driven by a servomotor, the vertical movement of the weaving frame being controllable and programmable, as a result of which this weaving frame with binding warp yarns (101, 201) which is situated above the top rapier at the point in time when the bottom rapier has to be supported, is lifted slightly higher than is required for shed-forming of the binding warp yarns (101, 201), so that the bottom beam of the weaving frame lifts the pile warp yarns (6) which are in the bottom position along in order to position them just below the bottom rapier.

22. Method according to claim 18, wherein a reciprocating weaving frame or a reciprocating table is used which is provided at the top with a surface which positions said pile warp yarns (6) just below the bottom rapiers.

23. Method according to claim 18, wherein a fixed table is used which always positions said pile warp yarns (6) just below the bottom rapier.

24. Method according to claim 23, wherein said fixed table is positioned as closely as possible to the rapiers in order to keep the zone wherein the pile warp yarns (6) and binding warp yarns (101, 201) meet as short as possible in positions where there are also binding warp yarns (101, 201) below the bottom rapiers.

25. Fabric (1, 2), comprising first weft yarns (3') and second weft yarns (4*a*, 4*b*, 4', 4");

a ground fabric (100, 200) which is composed of ground warp yarns, comprising one or more binding warp yarns (101,201), and said second weft yarns (4*a*, 4*b*, 4', 4") which are tied up in the ground fabric (100, 200);

one or more tension warp yarns (102, 202);

non-figure forming and/or figure forming pile warp yarns (6, 7), with the figure forming pile warp yarns (6) figure forming pile burls (6*a*, 6*b*) being formed;

wherein at least one set of two successive figure forming pile burls (6*a*, 6*b*) in the warp direction are alternately tied up over a said first weft yarn (3) which is situated on the back of the fabric (1, 2) outside the ground fabric (100, 200) over a width of the fabric, and over a said second weft yarn (4*a*, 4*b*, 4', 4").

26. Fabric comprising first weft yarns (3) and second weft yarns (4*a*, 4*b*, 4', 4");

a ground fabric (100, 200) which is composed of ground warp yarns, comprising one or more binding warp yarns (101, 201), and said second weft yarns (4*a*, 4*b*, 4', 4") which are tied up in the ground fabric (100, 200);

one or more tension warp yarns (102, 202);

non-figure forming and/or figure forming pile warp yarns (6, 7), with the figure forming pile warp yarns (6) figure forming pile burls (6*a*, 6*b*) being formed;

wherein at least one set of two successive figure forming pile burls (6*a*, 6*b*) in the warp direction are alternately tied up over a said first weft yarn (3) which is situated on the back of the fabric (1, 2) outside the ground fabric (100, 200) over a width of the fabric, and over a said second weft yarn (4*a*, 4*b*, 4', 4").

27. Fabric according to claim 25 wherein the fabric (1, 2) is manufactured in a 1/2V pile weave, wherein one pile burl (6*a*, 6*b*) is provided in each fabric (1, 2) for every 2 weft yarns (3, 4*a*, 4*b*, 4', 4") inserted per fabric (1, 2).

28. Fabric according to claim 25 wherein the fabric (1, 2) is manufactured in a 1+1/2V pile weave by using a 1/2V weave in combination with a ground weave in repeat 8, wherein per set of 4 weft yarns (3, 4*a*, 4*b*, 4', 4") per fabric (1, 2) one second weft yarn (5*b*) on the pile side of the fabric (1, 2) is not inserted.

29. Fabric according to claim 25 wherein the fabric (1, 2) is manufactured in a 2/3+1/1V pile weave by means of a weaving device having three weft-insertion means with a ground weave in repeat 8, wherein, over 4 weft-insertion cycles, 2 weft yarns per fabric are not inserted, in particular a first second weft yarn (5*b*) which, if it were to be inserted, would be on the back of the fabric (1, 2), and a second second weft yarn (5*a*) which, if it were to be inserted, would be on the pile side of the fabric (1, 2).

30. Fabric according to claim 25 wherein the fabric (1, 2) is manufactured by means of a weaving device having three weft-insertion means, with the formation in at least one pile warp yarn system of at least one set of two successive figure forming pile burls (6*a*, 6*b*) in the warp direction by alternately tying these up, in said fabric, over a first weft yarn (3) which is on the back of the fabric (1, 2) outside the ground fabric (100, 200), and over a second weft yarn (4*a*, 4*b*, 4', 4") which is tied up in the ground fabric (100, 200), in the warp direction being preceded or followed by two pile burls which are only tied up over first weft yarns (3), while the same succession of pile burls in the fabric occurs in an adjacent warp pile yarn system, with said figure forming pile burls which tie up over second weft yarns do not tie up over the same second weft yarns in the two adjacent pile warp yarn systems.

31. Fabric according to claim 25, wherein the fabric is woven according to the face-to-face weaving method.

32. Fabric according to claim 25, wherein the fabric is woven according to the single-piece weaving method.

* * * * *